US008523395B2

(12) United States Patent
Igaki et al.

(10) Patent No.: US 8,523,395 B2
(45) Date of Patent: Sep. 3, 2013

(54) LIGHT EMITTING DIODE LAMP AND METHOD FOR MANUFACTURING THE SAME

(75) Inventors: Masaru Igaki, Kyoto (JP); Takao Iemoto, Kyoto (JP); Hirotaka Shimizu, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 60 days.

(21) Appl. No.: 13/188,656

(22) Filed: Jul. 22, 2011

(65) Prior Publication Data

US 2012/0020087 A1 Jan. 26, 2012

(30) Foreign Application Priority Data

Jul. 22, 2010 (JP) ..... 2010-164755

(51) Int. Cl.
*F21V 14/00* (2006.01)

(52) U.S. Cl.
USPC ..... 362/256; 362/294; 362/373

(58) Field of Classification Search
USPC ..... 362/218, 249.02, 255, 256, 294, 362/373
See application file for complete search history.

(56) References Cited

U.S. PATENT DOCUMENTS

| | | | | |
|---|---|---|---|---|
| 3,067,352 | A * | 12/1962 | Vodicka | 362/255 |
| 3,634,679 | A * | 1/1972 | Krzyston | 362/811 |
| 8,154,179 | B2 * | 4/2012 | Chen | 362/294 |
| 8,246,215 | B2 * | 8/2012 | Lu et al. | 362/249.02 |
| 2009/0016063 | A1 * | 1/2009 | Hu | 362/373 |
| 2010/0091495 | A1 * | 4/2010 | Patrick | 362/249.02 |
| 2010/0172133 | A1 * | 7/2010 | Liu | 362/373 |

FOREIGN PATENT DOCUMENTS

JP 2010-056059 3/2010

* cited by examiner

*Primary Examiner* — Y My Quach Lee
(74) *Attorney, Agent, or Firm* — Hamre, Schumann, Mueller & Larson, P.C.

(57) ABSTRACT

A light emitting diode (LED) lamp includes a plurality of LED chips and a heat dissipation member configured to dissipate heat generated from the LED chips. The heat dissipation member includes a tubular unit having a constant cross-section perpendicular to an axial direction, and a plurality of fins, each of which extends outwardly from the tubular unit and extends in the axial direction, having a constant thickness in the axial direction.

20 Claims, 10 Drawing Sheets

LIGHT EMITTING DIODE LAMP AND METHOD FOR MANUFACTURING THE SAME

CROSS-REFERENCE TO RELATED APPLICATION

This application is based upon and claims the benefit of priority from Japanese Patent Application No. 2010-164755, filed on Jul. 22, 2010, the entire contents of which are incorporated herein by reference.

TECHNICAL FIELD

Embodiments relate to a light emitting diode (LED) lamp and a method for manufacturing the LED lamp.

BACKGROUND

As a substitute for an incandescent lamp, recently a light emitting diode (LED) lamp having an LED chip mounted thereon has been broadly used. Compared with an incandescent lamp, an LED lamp may have advantages in reduced power consumption and a long-lasting lifespan.

FIG. 14 illustrates an example of a conventional LED lamp (see, e.g., Japanese Laid-Open Patent Publication No. 2010-56059). As shown in FIG. 14, an LED lamp X includes LED modules 91, a cover 92, a heat dissipation member 93, and a screw-in base (hereinafter, referred to as a base) 95. Each of the LED modules 91 serves as a light emitting member that have an LED chip (not shown) mounted thereon. The cover 92 is configured to transmit light from the LED modules 91. The cover 92 has a substantially spherical shape. The heat dissipation member 93 is configured to dissipate heat generated from the LED modules 91. The heat dissipation member 93 is made of, e.g., aluminum. A plurality of fins 94 is formed on the heat dissipation member 93 so as to increase heat dissipation efficiency. The base 95 serves as a member for connecting the LED lamp X to a lighting apparatus having a socket for an incandescent lamp.

With the plurality of fins 94 provided, the heat dissipation member 93 may have a complicated structure. Also, a space should be provided inside the heat dissipation member 93 to accommodate electric wires and electronic components for supplying power to the LED modules 91. For integrally forming the heat dissipation member 93 having such configuration, it is required to die-cast a material, e.g., aluminum. Such a die-cast process may cause a cost increase in manufacturing the LED lamp X.

SUMMARY

The present disclosure provides some embodiments of a light emitting diode (LED) lamp and a method for manufacturing the LED lamp, which are capable of increasing heat dissipation efficiency and reducing manufacturing costs.

In accordance with one aspect of the embodiments of the present disclosure, an LED lamp includes a plurality of LED chips and a heat dissipation member configured to dissipate heat generated from the LED chips. The heat dissipation member includes a tubular unit having a constant cross-section perpendicular to an axial direction, and a plurality of fins, each of which protrudes outwards from the tubular unit and extends in the axial direction, having a constant thickness in the axial direction.

With such configuration, the heat dissipation member can be manufactured from an elongated member through an extrusion casting. The extrusion casting may be lower in cost than a die casting. Therefore, the manufacturing cost of the LED lamp can be reduced while securing sufficient heat dissipation efficiency.

According to another embodiment of the present disclosure, the LED lamp further includes a circuit board configured to mount thereon the LED chips, wherein the circuit board is attached to one end of the heat dissipation member in the axial direction.

According to another embodiment of the present disclosure, the tubular unit has a cylindrical shape.

According to another embodiment of the present disclosure, the plurality of fins are radially disposed centering on a central axis of the tubular unit, and dimensions of the plurality of fins in a radial direction perpendicular to the axial direction are gradually increased as they approach toward the LED chips.

According to another embodiment of the present disclosure, the LED lamp further includes a power supply unit configured to supply power to the LED chips, wherein the power supply unit is disposed in the tubular unit.

According to another embodiment of the present disclosure, the heat dissipation member is made of aluminum.

According to another embodiment of the present disclosure, the LED lamp further includes a base attached to the other end of the heat dissipation member opposite to the LED chips.

According to another embodiment of the present disclosure, the LED lamp further includes a cover configured to enclose the LED chips and to transmit light generated from the LED chips.

According to another embodiment of the present disclosure, a surface roughening is performed on an inner surface of the cover. The surface roughening may be performed on an outer surface of the cover.

In accordance with another aspect of the embodiments of the present disclosure, a method for manufacturing an LED lamp includes: forming an elongated member through an extrusion casting, wherein the elongated member includes a tubular unit having a constant cross-section perpendicular to an axial direction, and a plurality of fins, each of which protrudes outwards from the tubular unit and extends in the axial direction, having a constant thickness in the axial direction; cutting the elongated extended member at cross-section planes perpendicular to the axial direction, to thereby form the heat dissipation member; and fixing LED chips to the heat dissipation member.

According to another embodiment of the present disclosure, the tubular unit has a cylindrical shape.

According to another embodiment of the present disclosure, the plurality of fins is radially disposed centering on a central axis of the tubular unit.

According to another embodiment of the present disclosure, the fixing LED chips further includes: attaching the LED chips on a circuit board; and fixing the circuit board to one end of the heat dissipation member in the axial direction.

According to another embodiment of the present disclosure, the method may further include cutting the heat dissipation member to have a dimension at one end of the fin greater than a dimension at the other end of the fin in the axial direction.

According to another embodiment of the present disclosure, the method further includes accommodating a power supply unit configured to supply power to the LED chips in the tubular unit.

According to another embodiment of the present disclosure, aluminum is used in the extrusion casting.

According to another embodiment of the present disclosure, the method further includes attaching a base to the other end of the heat dissipation member opposite to the LED chips.

Other features and advantages according to preferable embodiments of the present disclosure will be apparent from the following descriptions described in detail with reference to the accompanying drawings.

DETAILED DESCRIPTION

Preferable embodiments in accordance with the present disclosure will now be described in detail with reference to the accompanying drawings.

Figure 1:
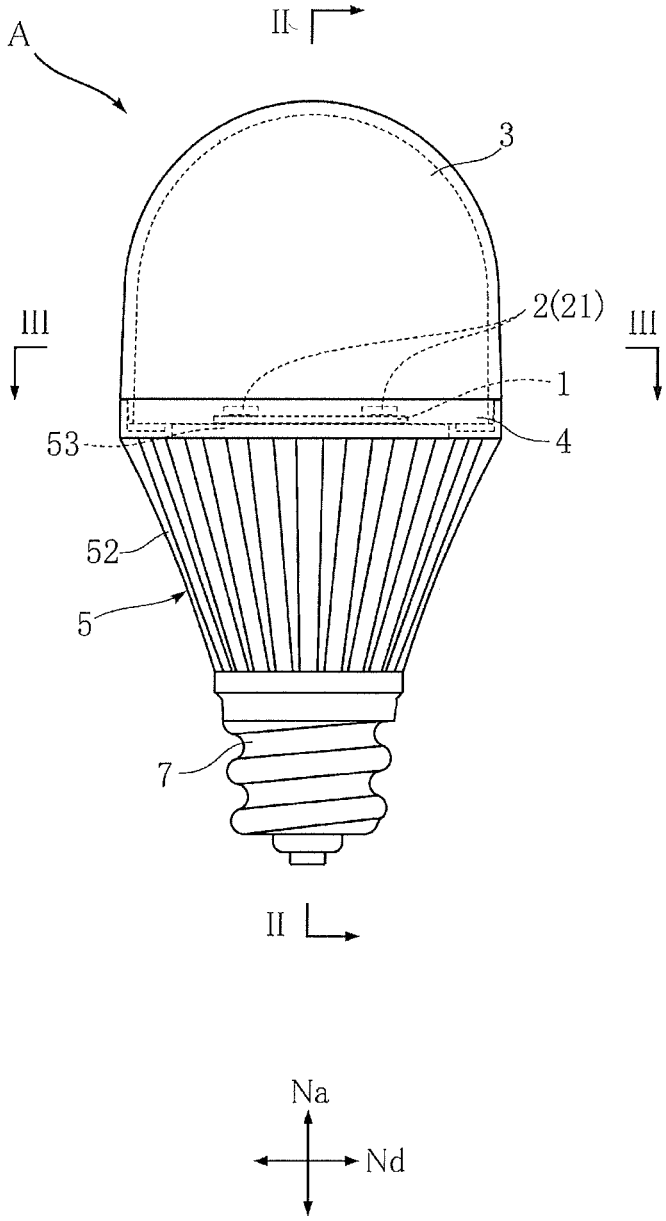
FIG. 1 is a front view showing one example of a light emitting diode (LED) lamp in accordance with the present disclosure.
Figure 2:
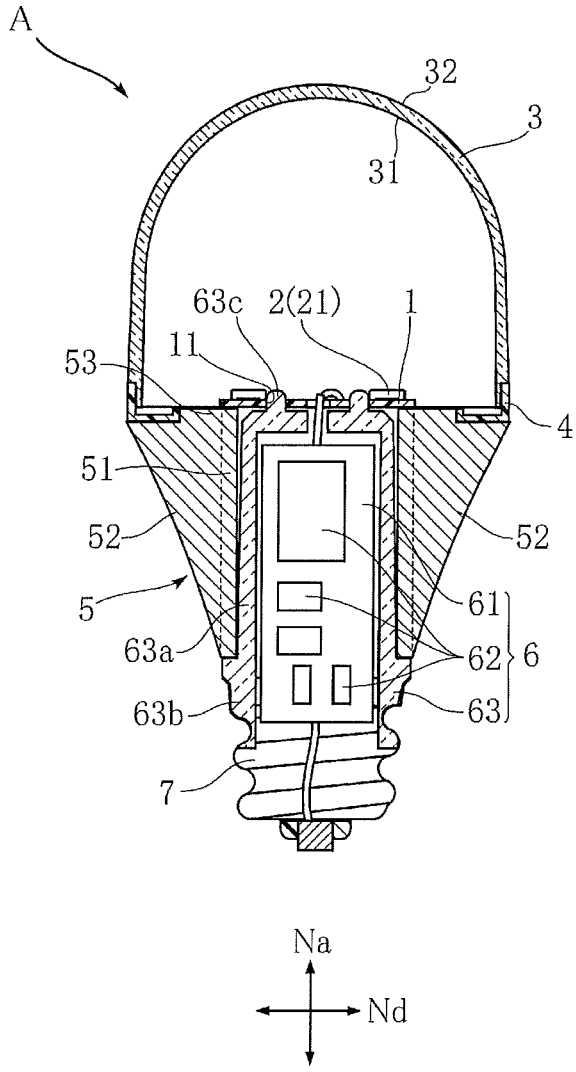
FIG. 2 is a cross-sectional view taken along a II-II line in FIG. 1.
Figure 3:
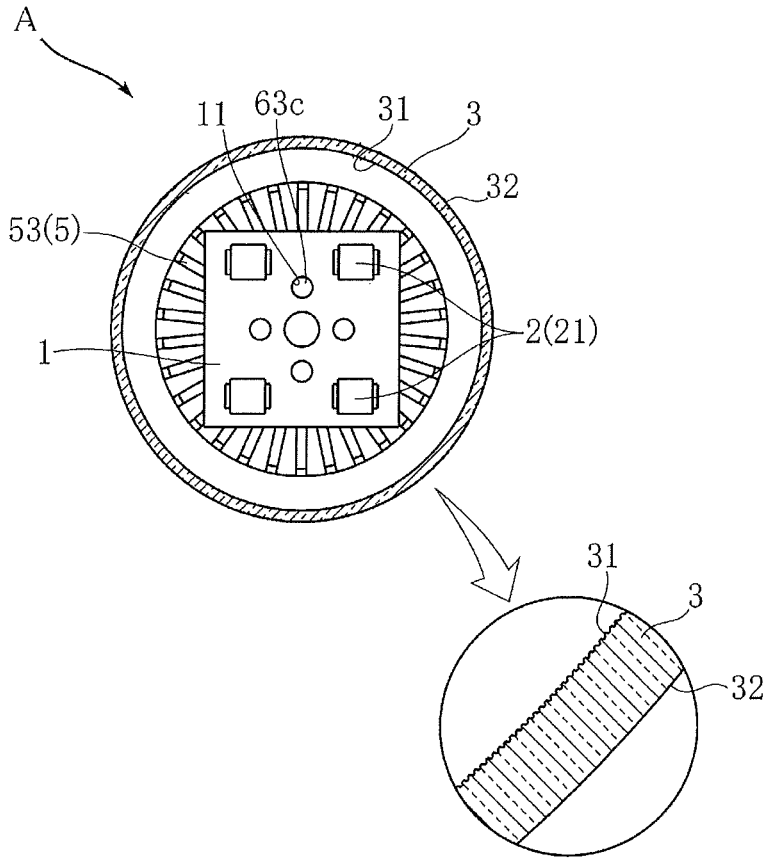
FIG. 3 is a cross-sectional view taken along a line in FIG. 1.

FIGS. 1, 2, and 3 show an example of a light emitting diode (LED) lamp in accordance with one embodiment of the present disclosure. As shown in FIGS. 1, 2, and 3, an LED lamp A according to one embodiment of the present disclosure includes a circuit board 1, a plurality of LED modules 2, a cover 3, a bracket 4, a heat dissipation member 5, a power supply unit 6, and a screw-in base (hereinafter, referred to as a base) 7. As a substitute for an incandescent lamp, the LED lamp A is used in a lighting apparatus having a socket for the incandescent lamp.

The circuit board 1 is configured to support the LED modules 2. The circuit board 1 includes a body made of, e.g., a glass epoxy resin, and a wiring pattern formed on the body. Alternatively, in some embodiments, the circuit board 1 may include a body, which is made of, e.g., aluminum, an insulation layer formed on the body, and a wiring pattern formed on the insulation layer. As shown in FIG. 3, in the present embodiment, the circuit board 1 has an approximately square shape. Referring to FIGS. 2 and 3, a plurality of attachment holes 11 are formed in the circuit board 1. The attachment holes 11 serve to attach the power supply unit 6 to the circuit board 1.

Figure 4:
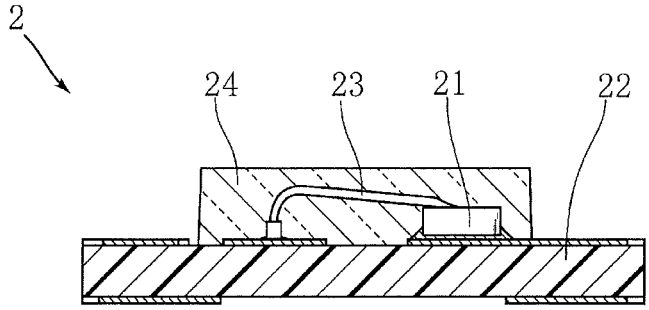
FIG. 4 is a cross-sectional view showing an example of an LED module in one embodiment of the LED lamp in accordance with the present disclosure.

The LED modules 2 serve as light emitting components for emitting, e.g., white light. As shown in FIG. 3, in the present embodiment, four LED modules 2 are mounted on four corners of the circuit board 1, for example. As shown in FIG. 4, each of the LED modules 2 includes an LED chip 21, a substrate 22, a wire 23, and an encapsulation resin 24. Alternatively, each of the LED modules 2 may include light emitting elements for emitting red light, green light, or blue light.

The LED chip 21 serves as a light source of the LED module 2. The LED chip 21 may include an n-type semiconductor layer made of, e.g., a GaN-based semiconductor, a p-type semiconductor layer, and an active layer interposed between the n-type semiconductor layer and the p-type semiconductor layer. The LED chip 21 is configured to emit blue light, for example. The substrate 22 is configured to support the LED chip 21. The substrate 22 may include a body made of, e.g., a glass epoxy resin, and a wiring pattern formed on the body. The wiring pattern includes a region for mounting the LED chip 21 and a region serving as a mounting electrode for surface-mounting the LED module 2.

The wire 23 is made of, e.g., gold. The wire 23 is configured to electrically connect an upper surface of the LED chip 21 and the wiring pattern to each other. The encapsulation resin 24 covers the LED chip 21 and the wire 23. For example, the encapsulation resin 24 is made of a material such as, e.g., a transparent epoxy resin or silicone resin mixed with a fluorescent substance. The fluorescent substance is excited by blue light emitted from the LED chip 21, thereby emitting yellow light, for example. The yellow light emitted from the fluorescent substance and the blue light emitted from the LED chip 21 are mixed with each other to produce white light. Alternatively, in some embodiments, the encapsulation resin 24 may be made of a transparent epoxy resin or silicone resin mixed with fluorescent substances that are excited by blue light to produce red light or green light.

The cover 3 may protect the LED modules 2. The cover 3 is made of, e.g., a transparent or semitransparent resin. In the present embodiment of the present disclosure, the cover 3 is configured as a semi-ellipsoid having an axial direction Na as a long axial direction. As shown in FIG. 3, an outer surface 32 of the cover 3 may have a smooth surface. On the other hand, an inner surface 31 of the cover 3 may have a rough surface formed through a surface roughening. For example, this surface roughening may be conducted by performing a shot-blasting treatment on a part of a die that is prepared to form the cover 3. The part on which the shot-blasting treatment is performed corresponds to the inner surface 31 of the cover 3. Alternatively, in some embodiments, the surface roughening may be further performed on the outer surface 32 in addition to the inner surface 31.

The bracket 4 serves to realize an easy connection between the cover 3 and the heat dissipation member 5. In the present embodiment of the present disclosure, the bracket 4 is made of, e.g., resin and has a ring-shape.

The heat dissipation member 5 is configured to dissipate heat generated from the LED modules 2. The heat dissipation member 5 includes a tubular unit 51, a plurality of fins 52, and platforms 53. The heat dissipation member 5 according to the present embodiment is made of, e.g., aluminum, and is formed through an extrusion casting as described later.

The tubular unit 51 is configured in a tubular shape having a central axis extended in the axial direction Na. In the present embodiment of the present disclosure, the tubular unit 51 is formed in a cylindrical tubular shape. The tubular unit 51 is formed to have a length covering the entire length of the heat dissipation member 5 in the axial direction Na. Cross-section of the tubular unit 51, which is perpendicular to the axial direction Na, may have a constant shape in the axial direction Na.

Figure 5:
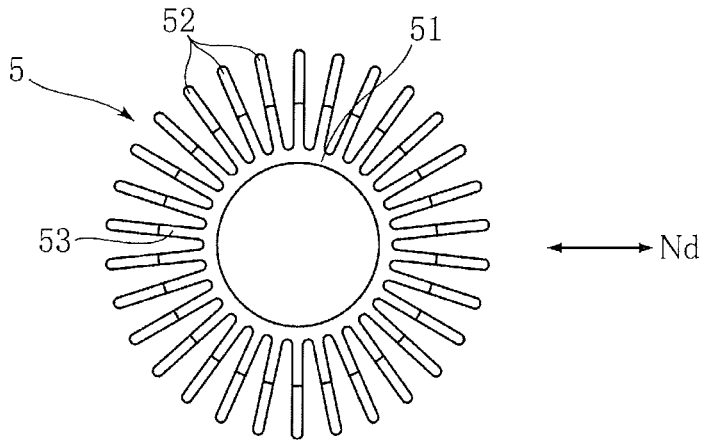
FIG. 5 is a plan view showing an example of a heat dissipation member in one embodiment of the LED lamp in accordance with the present disclosure.
Figure 6:
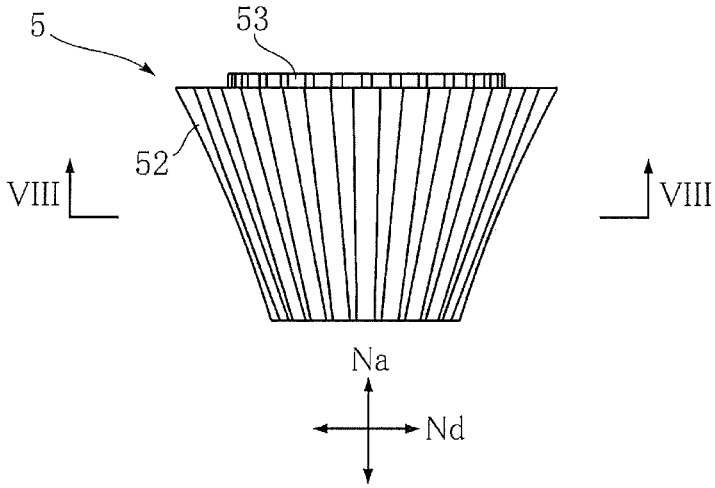
FIG. 6 is a front view showing an example of the heat dissipation member in one embodiment of the LED lamp in accordance with the present disclosure.
Figure 7:
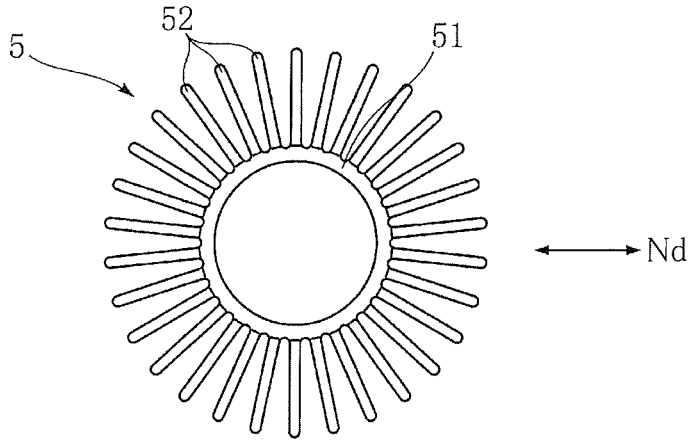
FIG. 7 is a bottom plan view showing an example of the heat dissipation member in one embodiment of the LED lamp in accordance with the present disclosure.
Figure 8:
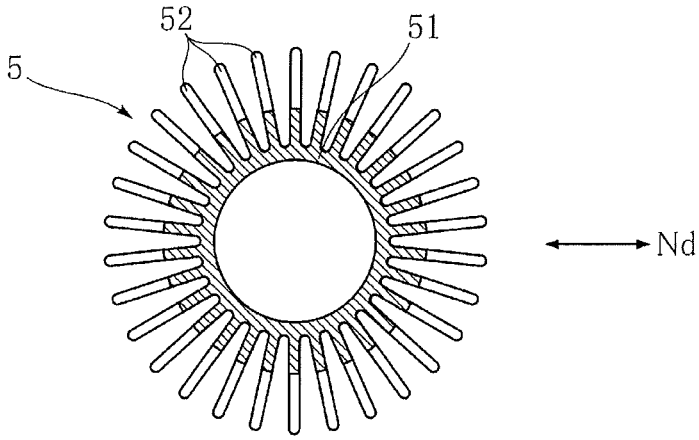
FIG. 8 is a cross-sectional view taken along a VIII-VIII line in FIG. 6.

The fins 52 are radially formed along a radial direction Nd from the tubular unit 51, centering on the central axis of the tubular unit 51. As shown in FIG. 5, FIG. 7, and FIG. 8, when viewed from the axial direction Na, thickness of the respective fins 52 in the axial direction Na is constant. Also, gaps are formed between every two neighboring fins 52 along the axial direction Na. As shown in FIG. 2 and FIG. 6, dimensions of the fins 52 in the radial direction Nd are gradually increased as approaching toward the LED modules 2 (LED chips 21) in the axial direction Na.

The platform 53 is disposed on an end portion of the heat dissipation member 5 in the axial direction Na. The platform 53 is slightly protruded from the fins 52 in the axial direction Na. As shown in FIGS. 5, 6, and 7, the platform 53 is formed by extending the tubular unit 51 and portions of the fins 52, which are close to the central axis of the tubular unit 51 in the radial direction Nd, in the axial direction Na. The platform 53 is configured to support the circuit board 1.

Figure 9:
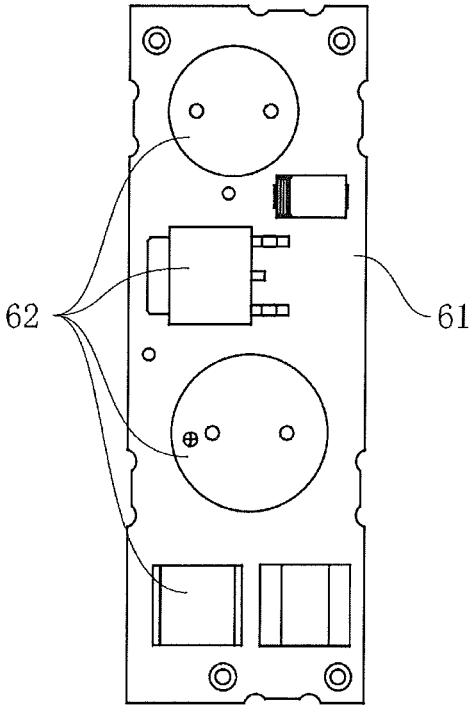
FIG. 9 is a front view showing a circuit board of a power supply unit and electronic components mounted thereon in one embodiment of the LED lamp in accordance with the present disclosure.
Figure 10:
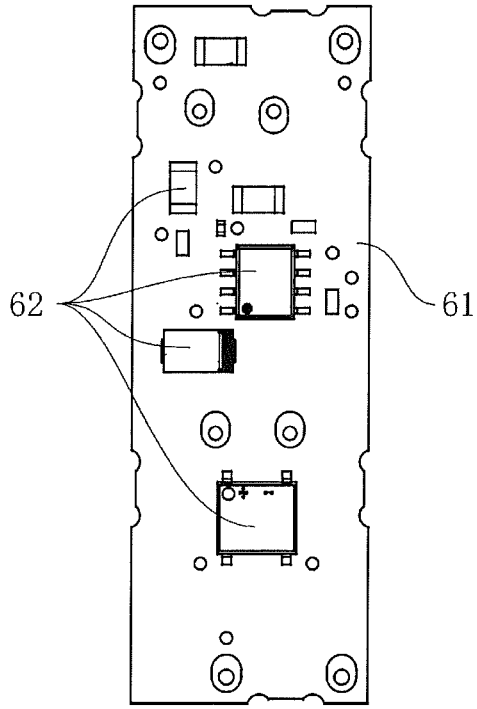
FIG. 10 is a rear view showing the circuit board of a power supply and electronic components mounted thereon in one embodiment of the LED lamp in accordance with the present disclosure.

The power supply unit 6 is configured to supply power to the LED modules 2 (LED chips 21). The power supply unit 6 includes a circuit board 61, a plurality of electronic components 62, and a case 63. The circuit board 61 is made of, e.g., a glass epoxy resin. In the present embodiment of the present disclosure, the circuit board 61 is configured to have a long rectangular shape that is extended in the axial direction Na as a longitudinal direction. The electronic components 62 serve to supply power to the LED modules 2 (LED chips 21). As shown in FIGS. 9 and 10, the electronic components 62 are mounted on front and rear surfaces of the circuit board 61. The electronic components 62 include, for example, a control IC (Integrated Circuit), a capacitor, a coil, a chip resistor, a diode, and the like.

The case 63 is made of, e.g., a semi-transparent resin. The case 63 includes a tubular part 63*a*, a screw part 63*b*, and a plurality of protrusions 63*c*. The tubular part 63*a* is configured to have a cylindrical shape with a bottom whose axial direction is parallel to the axial direction Na. The tubular part 63*a* is configured to contain the circuit board 61 and the electronic components 62. The screw part 63*b* is formed downward in the axial direction Na with respect to the tubular part 63*a*. The screw part 63*b* is configured to have a male screw shape that is screw-coupled with the base 7.

An outer diameter of the tubular part 63*a* of the case 63 is slightly smaller than an inner diameter of the tubular unit 51 of the heat dissipation member 5. Therefore, in the power supply unit 6, the tubular part 63*a* of the case 63, and the circuit board 61 and the electronic components 62 disposed inside the tubular part 63*a* may be accommodated in the tubular unit 51 of the heat dissipation member 5.

The protrusions 63*c* are configured to fix the circuit board 1. The protrusions 63*c* are inserted into the attachment holes 11 of the circuit board 1. Parts of the protrusion 63*c* exposing from the attachment hole 11 are thermally seared so as to securely fix the circuit board 1 to the case 63.

The base 7 serves as a member to be connected to a lighting apparatus having a socket for a general-purpose lamp in compliance with, e.g., JIS (Japanese Industrial Standard). The base 7 is configured to satisfy specifications such as, e.g., E17, E26, and the like which are defined in JIS. The base 7 is connected with the screw part 63*b* of the case 63 of the power supply unit 6 through a screw coupling.

Next, an embodiment of a method for manufacturing the LED lamp A will be described.

Figure 11:
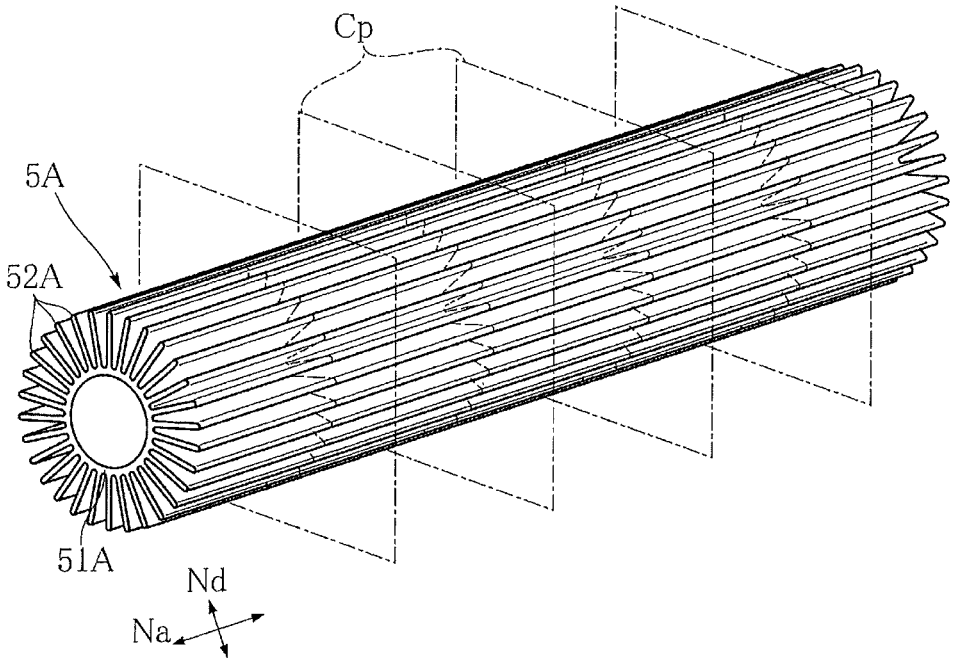
FIG. 11 is a perspective view showing an elongated member under a cutting process according to one embodiment of the LED lamp manufacturing method in accordance with the present disclosure.

Initially, an elongated member 5A shown in FIG. 11 is formed. The elongated member 5A includes a tubular portion 51A and a plurality of fins 52A. Cross-section of the elongated member 5A perpendicular to the axial direction Na has a constant shape in the axial direction Na. The tubular portion 51A is configured to have a cylindrical shape with a central axis following in the axial direction Na. The fins 52A are radially arranged centering on the central axis of the tubular portion 51A. The elongated member 5A is formed through an extrusion casting. For example, a billet made of aluminum is extruded from a die having a cross-section plane corresponding to the cross-section plane of the elongated member 5A, thereby continuously forming the elongated member 5A.

Figure 12:
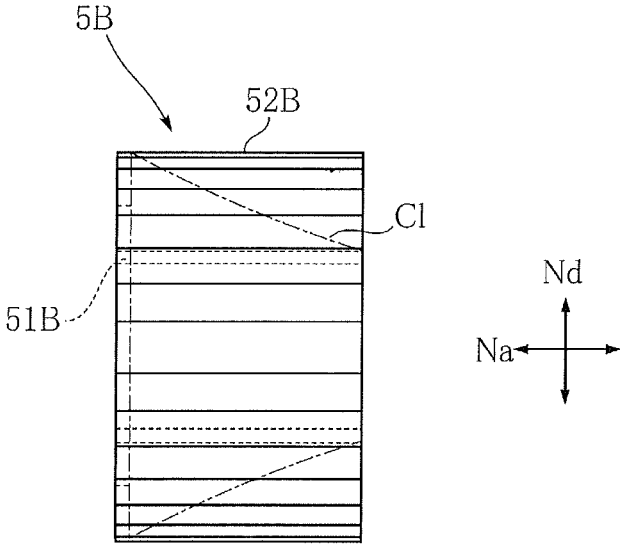
FIG. 12 is a front view showing a shortened member under a cutting process according to one embodiment of the LED lamp manufacturing method in accordance with the present disclosure.

Thereafter, the elongated member 5A is cut at cutting planes Cp. The cutting planes Cp are perpendicular to the axial direction Na and disposed at regular intervals. In this way, the elongated member 5A is divided into a plurality of shortened members 5B as shown in FIG. 12.

Subsequently, a tubular portion 51 B and fins 52B of the shortened member 5B are cut along cutting lines CI (i.e., dashed dot lines) shown in FIG. 12. Such a cutting process is performed by using, e.g., a wire. The cutting process along the cutting lines CI is performed on the shortened member 5B in all radial directions thereof. In this way, the heat dissipation member 5 shown in FIGS. 5 through 8 can be obtained.

Figure 13:
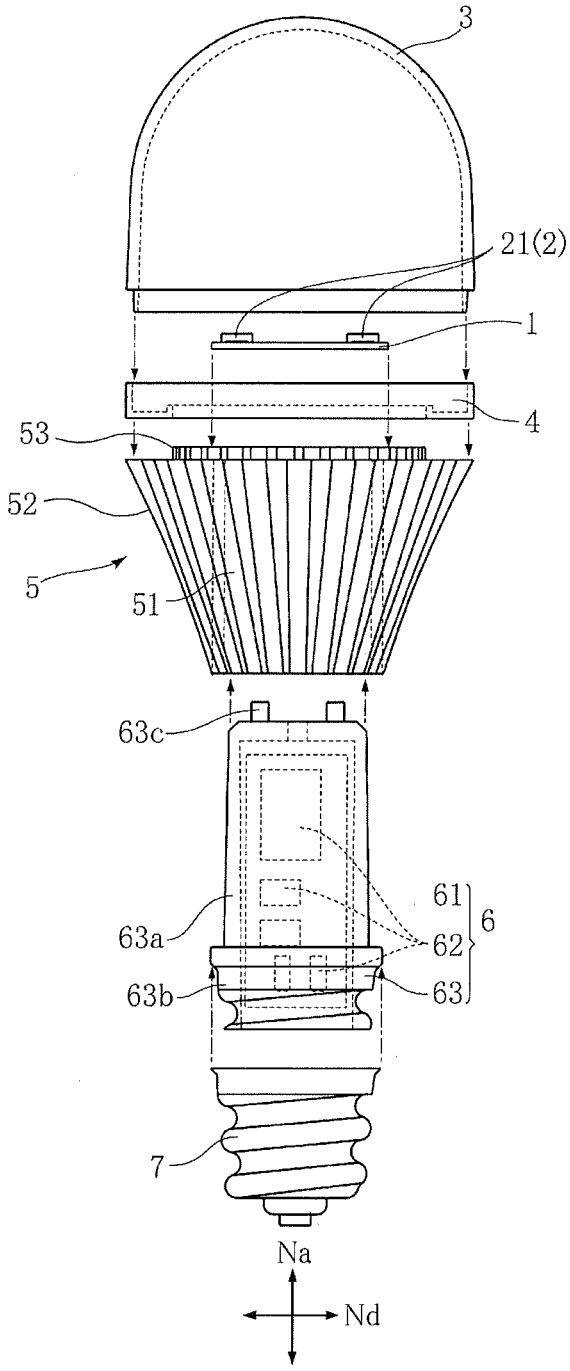
FIG. 13 is a front view showing an assembly process according to one embodiment of the LED lamp manufacturing method in accordance with the present disclosure.
Figure 14:
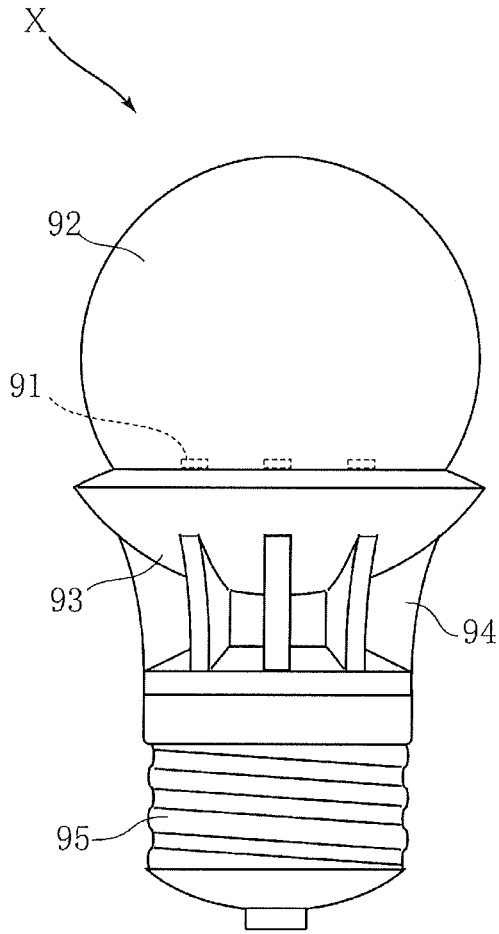
FIG. 14 is a front view showing an example of a conventional LED lamp.

Afterward, as shown in FIG. 13, the power supply unit 6 is inserted into the heat dissipation member 5. The protrusions 63*c* of the power supply unit 6 and the circuit board 1 are fixed to each other such that the circuit board 1 is attached to the platforms 53 of the heat dissipation member 5. Also, the cover 3 is attached to the heat dissipation member 5 through the bracket 4. The base 7 is attached to the screw part 63*b* of the power supply unit 6. Through the above described assembly process, the LED lamp A shown in FIGS. 1 through 3 can be obtained.

Hereinafter, an operation of the LED lamp A will be described in detail.

In accordance with the present embodiment, the heat dissipation member 5 includes a tubular unit having a constant cross-section perpendicular to an axial direction, and a plurality of fins, each of which protrudes outwards from the tubular unit and extends in the axial direction, having a constant thickness in the axial direction. As such, the heat dissipation member 5 can be manufactured from the elongated member 5A that is formed through the extrusion casting. The extrusion casting may be lower in cost than the die casting. Therefore, the manufacturing cost of the LED lamp A can be reduced.

In the case of using the die casting, it is difficult to widely spread a casting material to all corners of a die and thus the number of fins 52 would be limited. On the contrary, according to the present disclosure using the extrusion casting, there is no such problem. As a result, the large number of fins 52 may be formed, and heat dissipation efficiency of the heat dissipation member 5 can be improved. Moreover, in the case of using the extrusion casting, it is possible to increase a density of the heat dissipation member 5 in comparison with the die casting. The increased density may contribute to an increase of the thermal conductivity of the heat dissipation member 5 such that it improves the heat dissipation efficiency of the heat dissipation member 5.

Since dimensions of the fins 52 in the radial direction Nd become larger as they approach toward the LED module 2 in the axial direction Na, it is possible to increase the surface area of the portion of the heat dissipation member 5 near the LED module 2, which becomes hotter than the other portions thereof due to heat generated from the LED module 2. In this way, the heat dissipation efficiency of the heat dissipation member 5 may be effectively increased.

As described above, the circuit board 1 is attached to the platforms 53 such that heat transfer from the LED modules 2 to the heat dissipation member 5 may be efficiently conducted.

By accommodating the power supply unit 6 in the tubular unit 51, there is no need to prepare, e.g., a dedicated space for additionally disposing the power supply unit 6 in the axial direction Na. With such a configuration, miniaturization of the LED lamp A may be realized, especially, in a dimension in the axial direction Na.

As described above, by performing the surface roughening on the inner surface 31 of the cover 3, light from the LED modules 2 is diffused when emitted from the outer surface 32 of the cover 3. In this way, each of the LED modules 2 (LED chips 21) may not be recognized as an individual point light source when viewed from the outside of the LED lamp A. Therefore, similar to the conventional incandescent lamp, the LED lamp A may be recognized as a single light source whose light is emitted from the whole surface of the cover 3. Alternatively, in some embodiments, a more improved diffusion effect may be obtained when the surface roughening is performed on the outer surface 32 of the cover 3 in addition to the inner surface 31 thereof.

As described above, the shortened member 5B and the heat dissipation member 5 are formed from the elongated member 5A that is made through the extrusion casting of aluminum. Therefore, by changing the cutting planes Cp or the cutting lines CI, it may be possible to easily manufacture the heat dissipation member 5 having different dimensions in the axial direction Na, or having different shapes of the fins 52 when viewed from the radial direction Nd.

The LED lamp A in accordance with the present disclosure is not limited to the above-described embodiments. For example, a detailed configuration of the respective components or units of the LED lamp A may be modified in various ways.

While certain embodiments have been described, these embodiments have been presented by way of example only, and are not intended to limit the scope of the disclosures. Indeed, the novel embodiments described herein may be embodied in a variety of other forms. Furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A light emitting diode (LED) lamp comprising:

a plurality of LED chips;

a circuit board configured to mount thereon the LED chips;

a heat dissipation member configured to dissipate heat generated from the LED chips;

a cover configured to enclosed the LED chips and to transmit light generated from the LED chips; and a bracket disposed between the heat dissipation member and the cover and configured to attach the cover to the heat dissipation member, the bracket being provided separately from the heat dissipation member, wherein the heat dissipation member includes:

a tubular unit having a constant cross-section perpendicular to an axial direction, and a plurality of fins, each of which protrudes outwards from the tubular unit and extends in the axial direction, having a constant thickness in the axial direction, and wherein the circuit board is attached to one end of the heat dissipation member in the axial direction.

2. The LED lamp of claim 1, wherein the tubular unit has a cylindrical shape.

3. The LED lamp of claim 1, wherein the plurality of fins is radially disposed centering on a central axis of the tubular unit.

4. The LED lamp of claim 3, wherein dimensions of the plurality of fins in a radial direction perpendicular to the axial direction are gradually increased as they approach toward the LED chips.

5. The LED lamp of claim 1, further comprising:

a power supply unit configured to supply power to the LED chips, wherein the power supply unit is disposed in the tubular unit.

6. The LED lamp of claim 5, further comprising:

a case accommodated in the tubular unit and configured to accommodate therein the power supply unit.

7. The LED lamp of claim 6, wherein the case includes a plurality of protrusions and the protrusions are inserted into a plurality of attachment holes formed in the circuit board.

8. The LED lamp of claim 7, wherein parts of the protrusions exposing from the attachment holes are thermally seared.

9. The LED lamp of claim 1, wherein the heat dissipation member is made of aluminum.

10. The LED lamp of claim 1, further comprising:

a base attached to the other end of the heat dissipation member opposite to the LED chips.

11. The LED lamp of claim 1, wherein a surface roughening is performed on an inner surface of the cover.

12. The LED lamp of claim 11, wherein a surface roughening is performed on an outer surface of the cover.

13. A method for manufacturing an LED lamp, the method comprising:

forming an elongated member through an extrusion casting, wherein the elongated member includes a tubular unit having a constant cross-section perpendicular to an axial direction, and a plurality of fins, each of which protrudes outwards from the tubular unit and extends in the axial direction, having a constant thickness in the axial direction;

cutting the elongated member at cross-section planes perpendicular to the axial direction, to thereby form a heat dissipation member;

fixing LED chips to the heat dissipation member; and attaching a cover to the heat dissipation member through a bracket, wherein the cover is configured to enclosed the LED chips and to transmit light generated from the LED chips and the bracket is provided separately from the heat dissipation member and disposed between the heat dissipation member and the cover.

14. The method of claim 13, wherein the tubular unit has a cylindrical shape.

15. The method of claim 13, wherein the plurality of fins is radially disposed centering on a central axis of the tubular unit.

16. The method of claim 15, further comprising:

cutting the heat dissipation member to have a dimension at one end of the fin greater than a dimension of the other end of the fin in the axial direction.

17. The method of claim 13, wherein said fixing LED chips further includes:

attaching the LED chips on a circuit board; and fixing the circuit board to one end of the heat dissipation member in the axial direction.

18. The method of claim 13, further comprising:

accommodating a power supply unit configured to supply power to the LED chips in the tubular unit.

19. The method of claim 13, wherein aluminum is used in the extrusion casting.

20. The method of claim 13, further comprising:

attaching a base to the other end of the heat dissipation member opposite to the LED chips.

* * * * *